US005344379A

United States Patent [19]

Garrone

[11] Patent Number: 5,344,379

[45] Date of Patent: Sep. 6, 1994

[54] MACHINE FOR FOLDING SHEETS OF PAPER

[76] Inventor: Vittorio Garrone, Via Bres 14, 10099 San Mauro Torinese, Italy

[21] Appl. No.: 125,340

[22] Filed: Sep. 22, 1993

[30] Foreign Application Priority Data

Sep. 30, 1992 [IT] Italy ..... 92 A 000798

[51] Int. Cl.[5] ..... B65H 45/14

[52] U.S. Cl. ..... 493/441; 493/416; 493/419; 493/423

[58] Field of Search ..... 493/419–423, 493/416

[56] References Cited

U.S. PATENT DOCUMENTS 2,699,331 1/1955 McGarvey ..... 493/421

3,416,785 12/1968 Sherman ..... 493/420

4,225,128 9/1980 Holyoke ..... 493/421

FOREIGN PATENT DOCUMENTS 0390620 10/1990 European Pat. Off. .

*Primary Examiner*—Jack Lavinder

[57] ABSTRACT

A machine for folding sheets of paper, particularly for folding large sheets leaving a printer or copier, including first, second and third flexible entrainment means for entraining a sheet to be folded and defining first and second fold channels and actuable alternately in opposite senses to supply a sheet to be folded to the first and to the second folding channel alternately so as to achieve a fold each time the sheet passes from one to the other of the folding channels.

7 Claims, 4 Drawing Sheets

MACHINE FOR FOLDING SHEETS OF PAPER

DESCRIPTION

The present invention relates to a machine for folding sheets of paper, particularly for folding large sheets (typically sheets having a width of up to 1.25 m and a length of up to 10 m or more) output by a printer or copier, such as, for example, a large-format photocopier or machine for making blueprints.

More precisely, the invention relates to a folding machine of the type specified in the preamble to claim 1 in which a sheet is folded by the entrainment of the sheet alternately in two folding channels so that one fold is made each time the sheet passes from one folding channel to the other.

Folding machines are known which have flexible means for entraining the sheets, typically constituted by several sets of belts or strips which are put into motion by motorised rollers.

The machines of known type have shown themselves to be complicated and expensive, particularly because of the large number of rollers used.

The object of the present invention is to provide a folding machine of the type specified above which is simpler and more economical than known machines and which enables the folding to be achieved with greater precision.

According to the present invention, this object is achieved by a folding machine having the characteristics given in claim 1.

Figure 1:
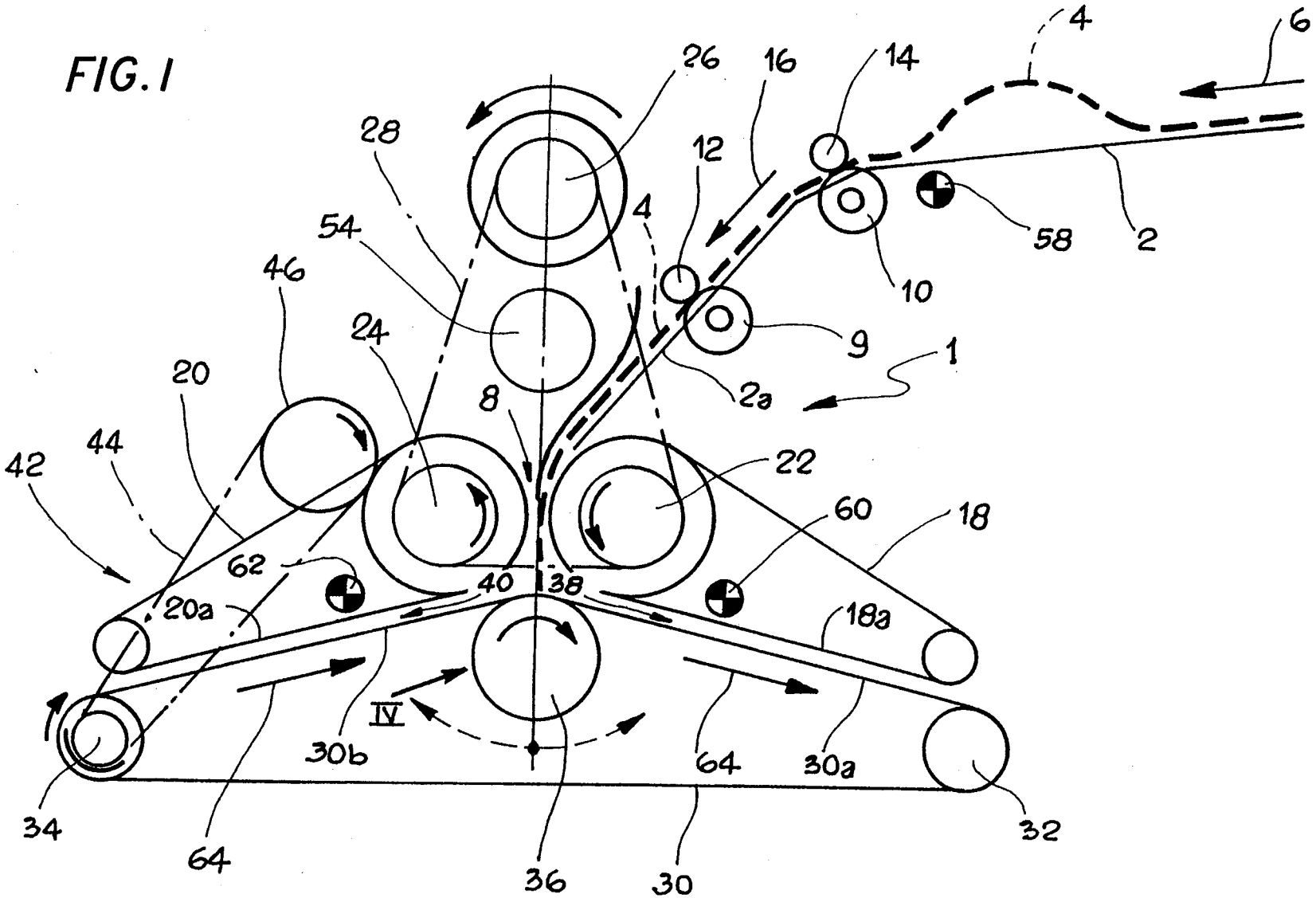
Figure 2:
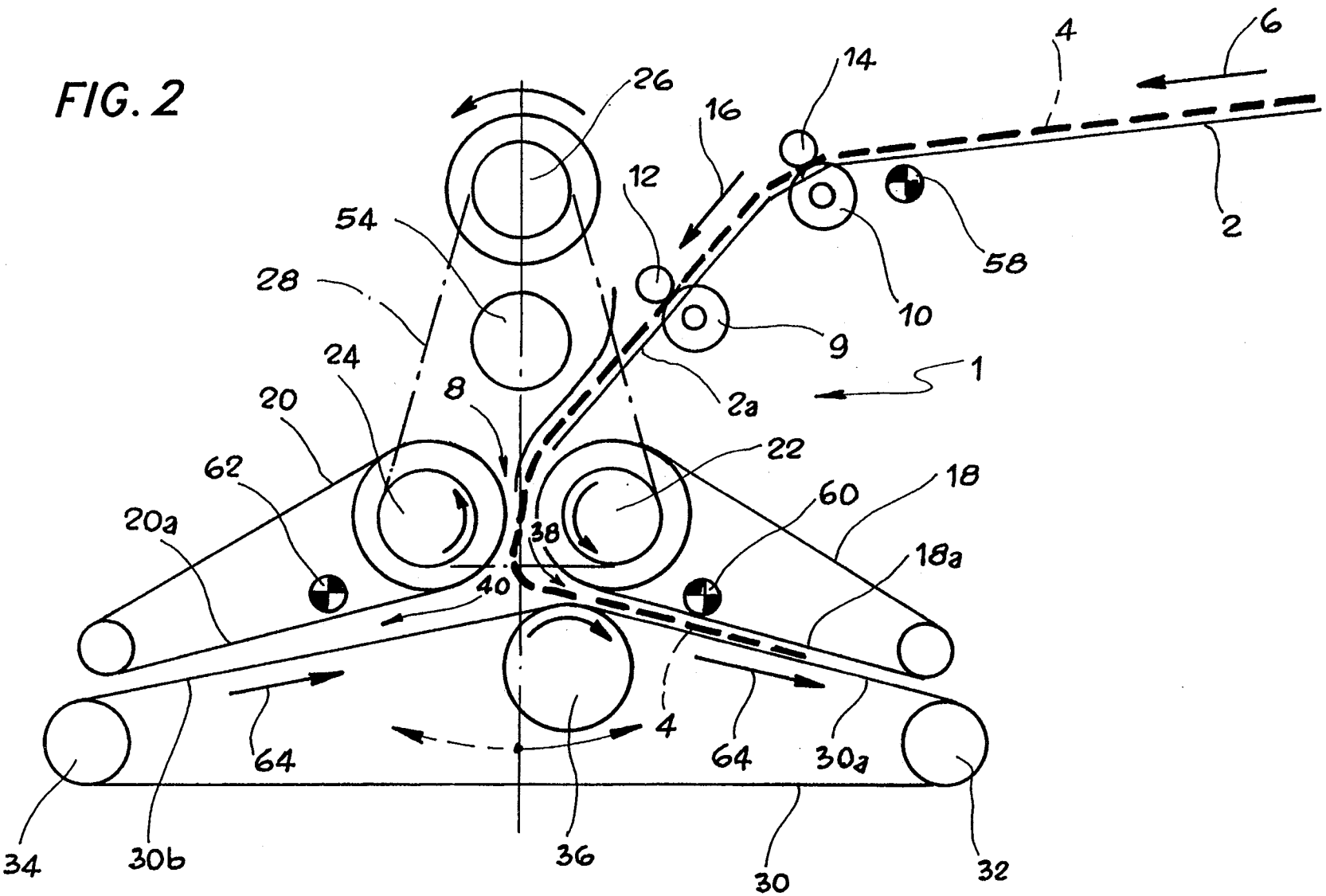
Figure 3:
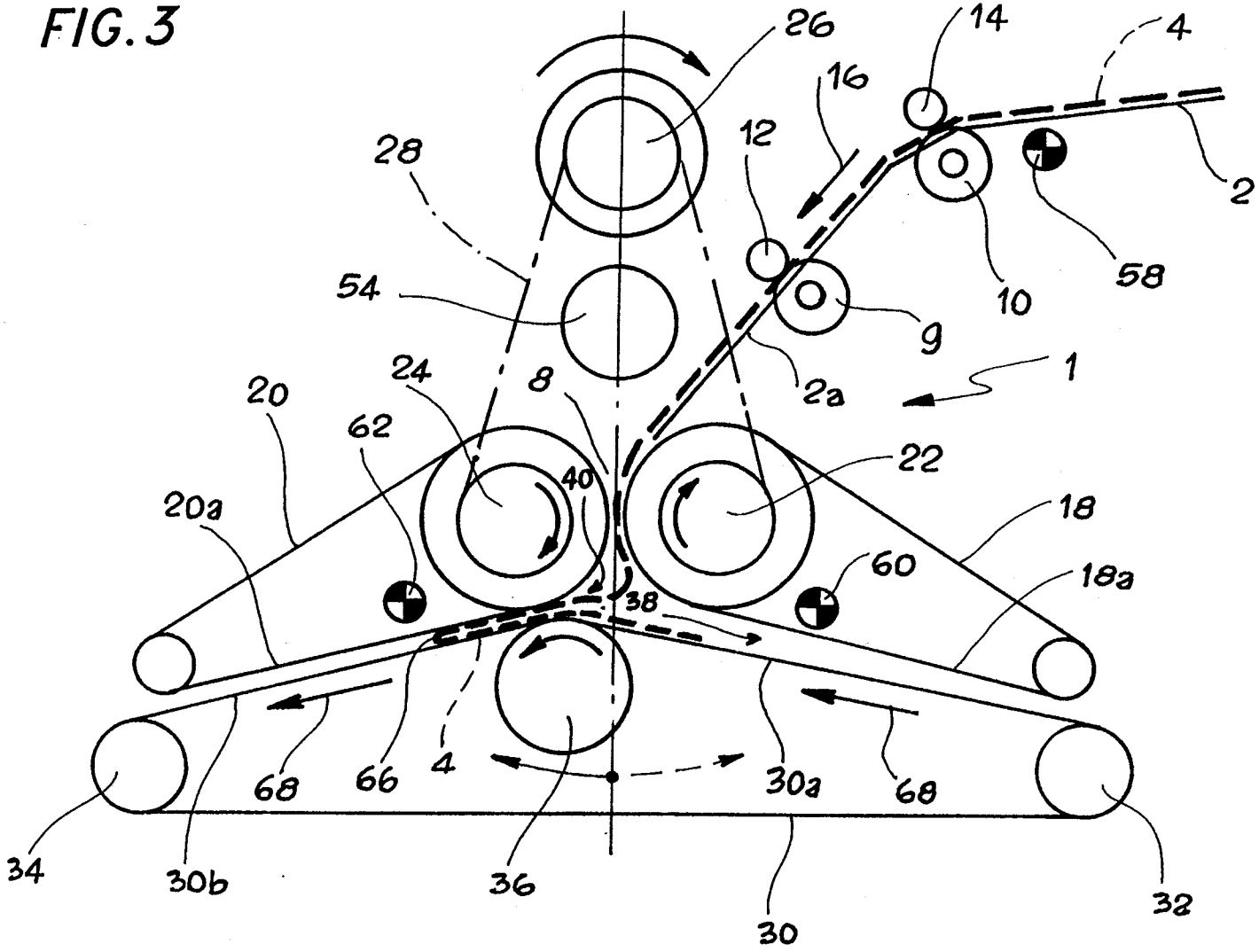
Figure 4:
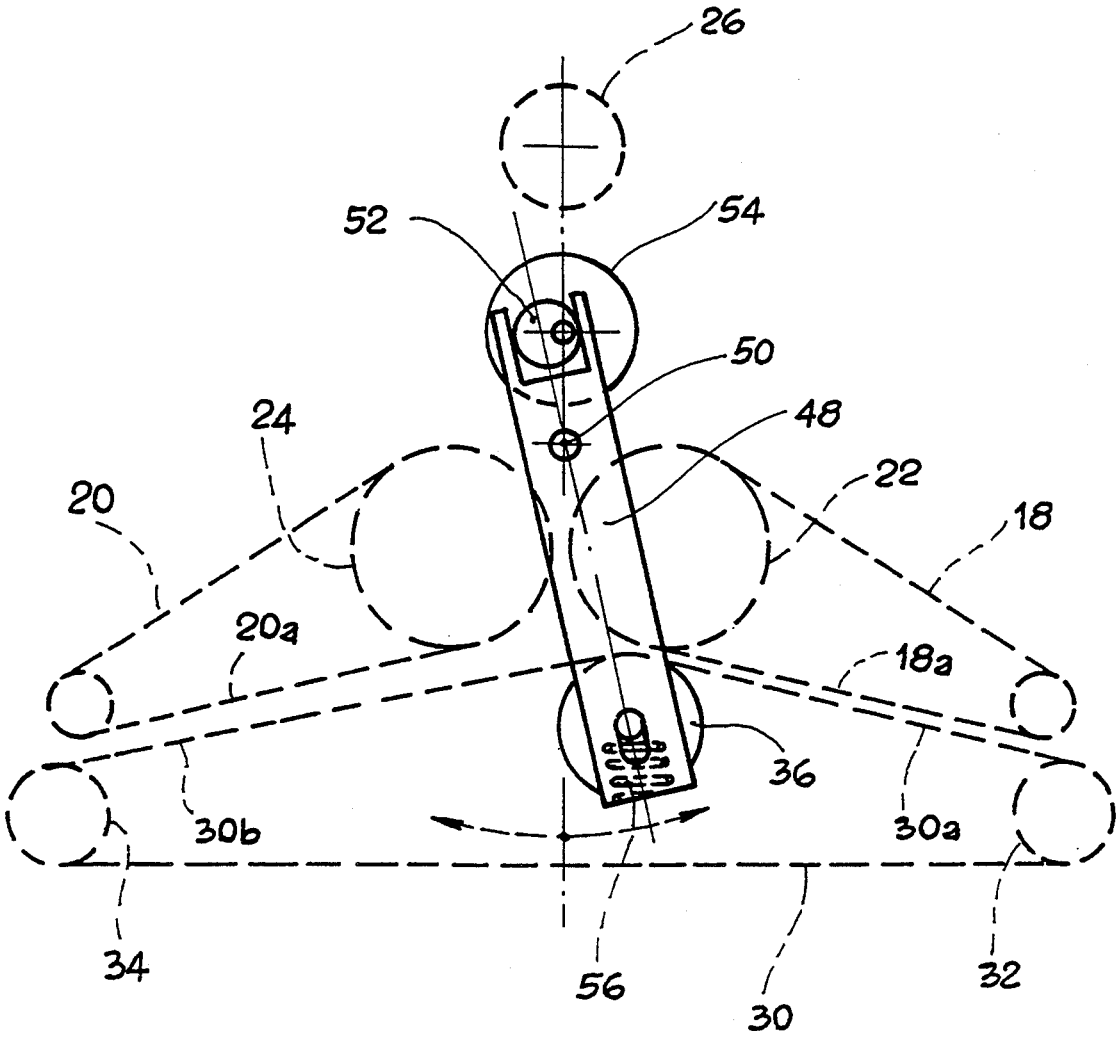

Further characteristics and advantages of the invention will become apparent during the course of the detailed description which follows, given purely by way of non-limited of example, with reference to the appended drawings, in which:

FIGS. 1, 2 and 3 are schematic views illustrating the operation of the machine according to the invention, and FIG. 4 is a schematic view illustrating the operation of the mechanism which controls the pivoting of the roller indicated by the arrow IV in FIG. 1.

With reference to FIGS. 1 to 3, a folding machine, indicated 1, includes a fixed plate 2 on which rests a sheet of paper 4 to be folded which is supplied in the direction indicated by the arrow 6 in FIG. 1 from the output section of a printer or copier. The plate 2 has an inclined portion 2*a* which leads to a vertical passage 8 through which the sheet 4 is fed to the folding device. Two sets of motor-driven feed rollers indicated 9 and 10 cooperate with respective sets of balls 12, 14. The motor-driven rollers 9, 10 drive the sheet 4 in the direction indicated by the arrow 16 towards the feed passage 8.

First and second sets of entrainment belts are indicated 18 and 20 respectively and are driven by a pair of drive rollers 22, 24 and together define the feed passage 8. The drive rollers 22, 24 are driven to rotate in the same sense by a single stepper motor 26 through a flexible transmission member 28.

A third set of entrainment belts 30 cooperates with a pair of pulleys 32, 34 and with a third drive roller 36. The third set of belts 30 has a pass 30*a* which is substantially parallel to a pass 18*a* of the first set of belts 18. A second pass 30*b* of the third set of belts 30 is substantially parallel to a pass 20*a* of the second set of belts 20. The passes 18*a* and 30*a* define a first folding channel 38 and the passes 20*a*, 30*b* define a second folding channel 40.

In FIG. 1 an auxiliary transmission indicated 42 includes a flexible transmission member 44 interposed between the pulley 34 and a roller 46. The roller 46 is connected to the second drive roller 24 by an electrically operated clutch (not illustrated). The auxiliary transmission 42 is ale to impart an entrainment velocity to the third set of belts 30 which is greater than that of the first and second sets of belts 18, 20.

As shown in greater detail in FIG. 4, the third drive roller 36 is carried by a pivotable structure 48 which is articulated about an axis 50 parallel to the axis of the roller 36. The pivoting of the structure 48 about the axis 50 is driven by a cam 52 controlled by a stepper motor 54. The roller 36 is free to move relative to the pivotable structure 48 in a direction perpendicular to its own axis of rotation, against the action of resilient means generally indicated 56.

The roller 36 can take up three operative positions. In the first of these positions, illustrated in FIG. 1, the roller 36 is in a position which is symmetrical relative to the drive rollers 22, 24 and located in correspondence with the feed passage 8. In the second and third operative positions, the roller 36 is pressed against the peripheral surface of the first drive roller 22 (FIG. 2) and against the peripheral surface of the second drive roller 24 (FIG. 3) respectively.

Three optical sensors indicated 58, 60 and 62 are arranged to detect the presence of a sheet of paper on the support plate 2 and in the first and second folding channels 38, 40 respectively. The sensors 58, 60 and 62 are connected to a conventional control unit which controls the activation of the motors 26, 54, the clutch for the roller 46 and the feed rollers 9, 10.

The folding machine operates as follows.

At the beginning of a folding cycle, the machine is in the configuration illustrated in FIG. 1, with the roller 36 in a symmetrical position between the two drive rollers 22, 24. The sensor 58 detects the presence of a sheet of paper 4 and actuates the feed rollers 9, 10 and the motor 26 which is driven in an anticlockwise sense and drives the rollers 22, 24 to rotate in the anticlockwise sense. The sensor 58 also controls the actuation of the clutch for the roller 46 which, through the auxiliary transmission 42, drives the third set of belts 30 in the sense indicated by the arrows 64.

The folding machine is started automatically and without the need for the folding velocity to be set according to the type of copier to which the folding machine is connected since the activation of the motor 26 is controlled by the sensor 58 in dependence on the velocity at which the paper is output by the copier.

The end of the sheet of paper 4 comes into contact with the third set of transmission belts 30 and is forwarded to the first folding channel 38. Given that in this phase the roller 36 rotates at a greater velocity than the rollers 22, 24, the end of the sheet 4 is inserted correctly into the folding channel 38 even if there are wrinkles in the front edge of the sheet.

When the sensor 60 detects the presence of the sheet 4 in the channel 38, the clutch for the roller 46 is disconnected and the motor 54 causes the structure 48 which carries the drive roller 36 to pivot against the roller 22 (FIG. 2). In this condition, the third set of entrainment belts 30 takes drive by frictional contact with the first set of belts 18.

When the length of the sheet 4 in the first folding channel 38 reaches the desired length for the fold to be made (detected by the sensor 60), the control unit of the machine 1 causes the sense of rotation of the motor 26 to be reversed and simultaneously actuates the motor 54 which carries the third drive roller 36 into contact with the second drive roller 24 (FIG. 3). This transfers the sheet 4 from the first folding channel to the second. During this transfer, a first fold 66 is formed in the sheet 4. The third set of belts 30 is driven in the sense indicated by the arrows 68 in FIG. 3 by virtue of their frictional contact with the second set of belts 20. When the optical sensor 62 detects that the desired length of the sheet for the fold to be made is in the second folding channel 40, the sense of rotation of the motor 26 is again reversed and the motor 54 is again actuated to return the drive roller 36 into contact with the roller 22.

The phases described above are repeated until the sheet 4 is exhausted. The increasing thickness of the sheet 4 in the folding channels 38, 40 is compensated for by the yielding of the resilient means 56 (FIG. 4) which press the roller 36 against the rollers 22, 24.

The arrangement of the three rollers 22, 24 and 36 enables the space between these rollers to be minimised, thus giving a smaller movement of the sheet during the folding phase and hence enabling better precision in the folding to be achieved.

What is claimed is:

1. In a machine for folding sheets of paper, particularly for folding large sheets leaving a printer or copier, including first, second and third flexible entrainment means for entraining a sheet to be folded, said first and third entrainment means having respective passes which are substantially parallel to each other and define a first folding channel and said second and third entrainment means having respective passes which are substantially parallel to each other and define a second folding channel, in which said first, second and third entrainment means are actuable alternately in opposite senses so as to supply a said sheet to be folded to said first and to said second folding channels alternately so as to form a fold each time said sheet passes from one of said folding channels to the other of said folding channels, and in which said first and second entrainment means cooperate with a first drive roller and with a second drive roller respectively which together define a feed passage for said sheet to be folded, the improvement comprising a third drive roller which cooperates with said third entrainment means and which is movable between a position in which it is pressed against said first drive roller and which it occupies during the phase of entrainment of said sheet in said first folding channel and a position in which it is pressed against said second drive roller and which it occupies during the phase of entrainment of said sheet in said second folding channel.

2. A machine according to claim 1, wherein said third entrainment means are arranged to contact said first and second entrainment means to receive drive therefrom during the folding cycle.

3. A machine according to claim 1, wherein said third drive roller defines a rotation axis and said machine includes a support structure which supports said drive roller and is pivotable in a plane perpendicular to said rotation axis to effect the movement of said drive roller.

4. A machine according to claim 3, wherein said third drive roller is mounted on said support structure for movement relative thereto in a direction perpendicular to its said rotation axis and wherein resilient means are provided for opposing said movement.

5. A machine according to claim 1, including a single motor connected to drive said first and second drive rollers in concordant senses, said motor operating alternately in opposite senses during the folding cycle.

6. A machine according to claim 1, wherein said third drive roller can take up a position intermediate its said positions in which it is pressed against said first and second drive rollers and in which it is located in correspondence with said feed passage, and wherein said machine includes a drive pulley arranged to drive said third entrainment means when said drive roller is in said intermediate position, said drive pulley being operative solely during a phase in which the end of a new said sheet to be folded is introduced into said machine and being arranged to impart a higher velocity to said third entrainment means than that of said first and second entrainment means.

7. A machine according to claim 6, further including a transmission for connecting said drive pulley to receive drive from a selected one of said first and second drive rollers, said transmission including a disengageable clutch and means for disengaging said clutch at the end of the phase in which the end of a new sheet to be folded is introduced.

* * * * *